US010099755B2

(12) United States Patent
O'Maley, Jr.

(10) Patent No.: US 10,099,755 B2
(45) Date of Patent: Oct. 16, 2018

(54) MARINE RAIL MOUNTED LIGHTING SYSTEM AND ASSOCIATED METHODS

(71) Applicant: John C. O'Maley, Jr., Pomeroy, OH (US)

(72) Inventor: John C. O'Maley, Jr., Pomeroy, OH (US)

( * ) Notice: Subject to any disclaimer, the term of this patent is extended or adjusted under 35 U.S.C. 154(b) by 127 days.

(21) Appl. No.: 14/640,793

(22) Filed: Mar. 6, 2015

(65) Prior Publication Data

US 2015/0251735 A1 Sep. 10, 2015

Related U.S. Application Data

(60) Provisional application No. 61/949,535, filed on Mar. 7, 2014.

(51) Int. Cl.

| | |
|---|---|
| ***B63B 45/00*** | (2006.01) |
| ***B63B 45/04*** | (2006.01) |
| ***F21V 21/088*** | (2006.01) |
| *F21S 9/02* | (2006.01) |
| *F21S 9/03* | (2006.01) |
| *F21V 9/08* | (2018.01) |
| *F21Y 115/10* | (2016.01) |
| *F21W 107/20* | (2018.01) |

(52) U.S. Cl.

CPC ..... *B63B 45/04* (2013.01); *F21V 21/088* (2013.01); *F21S 9/02* (2013.01); *F21S 9/037* (2013.01); *F21V 9/08* (2013.01); *F21W 2107/20* (2018.01); *F21Y 2115/10* (2016.08); *Y10T 29/49826* (2015.01)

(58) Field of Classification Search

CPC ..... B63B 45/04; F21V 21/088; F21S 9/02
USPC ..... 362/477, 396, 473
See application file for complete search history.

(56) References Cited

U.S. PATENT DOCUMENTS 4,884,173 A * 11/1989 Cassidy ..... B60Q 1/24 362/243
6,802,633 B1 * 10/2004 VandenBossche ..... B63B 17/00 362/191
2007/0086186 A1 * 4/2007 Rohlfing ..... F21S 8/00 362/240

(Continued)

OTHER PUBLICATIONS

Navigation Rules. Littleton, CO: Colorado Division of Parks and Outdoor Recreation, 1988. 38-48. Print.*

*Primary Examiner* — Evan Dzierzynski
*Assistant Examiner* — Gerald J Sufleta, II
(74) *Attorney, Agent, or Firm* — Dinsmore & Shohl LLP

(57) ABSTRACT

A pivoting rail mounted lighting system for boats which includes three separate portable housings and a light source located in these housings. Each light source being visible from outside the housing such that when the first housing is illuminated, a red colored light source is illuminated for rail mounting to the Port side of the vessel, when the second housing is illuminated, a green colored light source is illuminated for rail mounting to the Starboard side of the vessel, and when the third housing is illuminated, an All Around white light is illuminated for rail mounting to the portions of the vessels railing systems. A quick connect and release pivoting bracket is connected to the housings and is designed to releasably connect to multiple positions along boat railings and allow the light housings to be "pivoted" into the proper direction to display the correct angle of light.

19 Claims, 10 Drawing Sheets

(56) References Cited

U.S. PATENT DOCUMENTS

| | | | | |
|---|---|---|---|---|
| 2009/0016054 | A1* | 1/2009 | Chien | F21S 8/035 362/249.07 |
| 2011/0128729 | A1* | 6/2011 | Ng | B63B 45/04 362/231 |
| 2011/0242819 | A1* | 10/2011 | Mitchell | B60Q 1/0483 362/311.02 |
| 2013/0100652 | A1* | 4/2013 | Guinon | F21V 3/02 362/184 |
| 2015/0003063 | A1* | 1/2015 | Hu | G02B 3/00 362/245 |
| 2015/0096402 | A1* | 4/2015 | Hirotomi | B62K 23/06 74/491 |

* cited by examiner

MARINE RAIL MOUNTED LIGHTING SYSTEM AND ASSOCIATED METHODS

CROSS REFERENCE TO RELATED APPLICATIONS

The present specification claims priority to U.S. Provisional Patent Application Ser. No. 61/949,535, filed Mar. 7, 2014 and entitled "RAIL MOUNTED SECONDARY (BACK UP) LIGHTING SYSTEM AND ASSOCIATED METHODS," the entirety of which is incorporated by reference herein.

TECHNICAL FIELD

The present application relates to pivoting rail mounted, externally wireless and portable boat lighting systems for use as primary or secondary or back up or for use in an emergency and methods of their use.

BACKGROUND

In various areas of the world, navigational lights are required for vessels, the requirements of which may depend on the size of the vessel. The requirements of navigational lights typically apply between sunset and sunrise or in low visibility conditions. For example, the United States Coast Guard requires power-driven vessels less than 39.4 feet in length to display red and green sidelights visible from a distance of at least one mile away on a dark clear night. Unpowered vessels less than 23 feet long exhibit the same lights as for powered vessels less than 39.4 feet in length, if practical. Various other lighting requirements for vessels may be applicable, depending on the location.

SUMMARY

In the first of three embodiments, a portable and externally wireless navigational lighting system includes a housing and a light source located in the housing and being visible from outside the housing such that when the light source is illuminated, the Marine Red color is displayed. A mount structure includes a quick connect and release pivoting bracket connected to the housing. The quick connect and release pivoting bracket is configured to releasably connect to and from a railing structure such as those used on the bow (Front), side and/or stern (Back) of boats. Once placed on the railing of the boat, the mounting structure may allow pivoting to more effectively display the light at the correct angle of visibility as set forth by local navigational law. The portable navigational lighting system is configured to display one of the first (Red) or second (Green) colors. In this embodiment, we will assume the Red or Port light. This light is specifically designed to quickly mount to the Port side railing of the boat for use as a primary or secondary light or back up light due to power failure or for use in an emergency where power to the primary navigation light has been lost.

In the second of three embodiments, a portable and externally wireless navigational lighting system includes a housing and a light source located in the housing and being visible from outside the housing such that when the light source is illuminated, the Marine Green color is displayed. A mount structure includes a quick connect and release pivoting bracket connected to the housing. The quick connect and release pivoting bracket is configured to releasably connect to and from a railing structure such as those used on the bow (Front), side and/or stern (Back) of boats. Once placed on the railing of the boat, the mounting structure may allow pivoting to more effectively display the light at the correct angle of visibility as set forth by local navigational law. The portable navigational lighting system is configured to display one of the first (Red) or second (Green) colors. In this embodiment, we will assume the Green or Starboard light. This light is specifically designed to quickly mount to the Starboard side railing of the boat for use as a primary or secondary light or back up light due to power failure or for use in an emergency where power to the primary navigation light has been lost.

In the third of three embodiments, a portable navigational lighting system includes a housing and a light source located in the housing and being visible from outside the housing such that when the light source is illuminated an All Around White Light is displayed which is visible from 360 degrees. A mount structure includes a quick connect and release bracket connected to the housing. The quick connect and release bracket is specifically configured to quickly releasably connect to and from a railing structure such as those commonly used on the Bimini (Top), Console (Middle) or Anchored areas (Back) of boats. This light is specifically designed to quickly mount to a Top railing of the boat for use as a primary or secondary 360 degree light or back up 360 degree light due to power failure or for use in an emergency where power to the primary 360 degree navigation light has been lost.

In one embodiment, a portable and externally wireless navigational lighting system may include a housing, a light source, a pin and lock system, a pivoting bracket, and a clamp mechanism. The light source may be located in the housing and visible through the housing when illuminated. The pin and lock system may include a shaft. The pivoting bracket may be releasably connectable to the housing at a first end and pivotally disposed around the shaft of the pin and lock system at a second end. The clamp mechanism may have walls defining an aperture disposed around and attached to the shaft of the pin and lock system. The clamp mechanism may be releasably attachable to a rail of a boat.

In another embodiment, method of using a portable and externally wireless navigational lighting system may include providing a housing, locating a light source in the housing, placing a lens over the light source, and providing a pin and lock system including a shaft. The light source may be visible through the housing when illuminated. The lens may externally illuminate at least an angle segment of light from the light source and control a direction of illumination. The method may further include releasably connecting a pivoting bracket to the housing at a first end and disposing the pivoting bracket around the shaft of the pin and lock system at a second end. The method may further yet include attaching a clamp mechanism to the shaft of the pin and lock system, releasably attaching the clamp mechanism to a rail of a boat, pivoting the pivoting bracket to a selected angle with respect to the rail and facing away from the boat, and locking, via the pin and lock system, the pivoting bracket in position at the selected angle. The clamp mechanism may have walls defining an aperture that may be disposed around the shaft of the pin and lock system.

In yet another embodiment, method of using a portable and externally wireless navigational lighting system may include providing a housing, locating a light source in the housing, placing a lens over the light source, and releasably connecting the housing to a rail of a boat. The lens may externally illuminate at least an angle segment of light from the light source and control a direction of illumination.

Each of the three embodiments and other embodiments above may include the ability to be or not be: waterproof, solar powered, and/or rechargeable, equipped with GPS, RFID capabilities or other location detecting devices for specific location capturing abilities, equipped with safety straps or used by remote control.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein are generally directed to rail mounted visibility systems used for navigation on recreational watercraft. The visibility systems include elements that increase the visibility of the recreational watercraft in low-visibility conditions, for example, when operating the recreational watercraft at morning, dusk, or night-time conditions or other low-light and/or low visibility conditions. The visibility systems may include marine navigational light sources that are attached to the recreational watercraft's railing system via a pivoting bracket system and actively emit and/or disperse light in a pattern corresponding to the navigational regulations. Embodiments of the visibility systems will be described in more detail with reference to the appended drawings.

Some embodiments described herein are generally directed to visibility systems that include portable navigational lighting systems including navigational light schemes. The portable navigational lighting systems may include a housing that houses light sources, where the light sources comply with marine navigation regulations and/or color schemes. The navigational lighting systems can be removably attached to multiple areas along the vessel's railing system and pivoted to disperse navigational light to the proper angles as required by law. This allows for the navigational lighting system to be placed onto the vessel's railing system at anywhere between the front and center location down to the side middle location of the vessel's railing system and then pivoted to the correct angle to disperse the light to its proper direction as required by law. In embodiments, the light is dispersed or shines away from the boat. In other embodiments, the light is dispersed all-round the boat. In embodiments, as described in greater detail further below, the light sources described herein may be used as a sidelight, a sternlight, a masthead light, and/or an all-round light to disperse the light to its proper direction as required by law. In embodiments, as a sidelight, the light may be dispersed at an angle in a range of from about 110 degrees to about 120 degrees, for example, at about a 112.5 degrees angle; as a sternlight, the light may be dispersed at an angle in a range of from about 130 degrees to 140 degrees, for example, at a 135 degrees angle; as a masthead light, the light may be dispersed at an angle in a range of from about 220 to about 230 degrees, for example, at about a 225 degrees angle, and as an all-round light, the light may be dispersed at an about 360 degrees angle. In embodiments, for power-driven vessels of less than 39.4 feet in length, for example, the all-round light may combine the sternlight and masthead lights that may be required by law.

Figure 1:
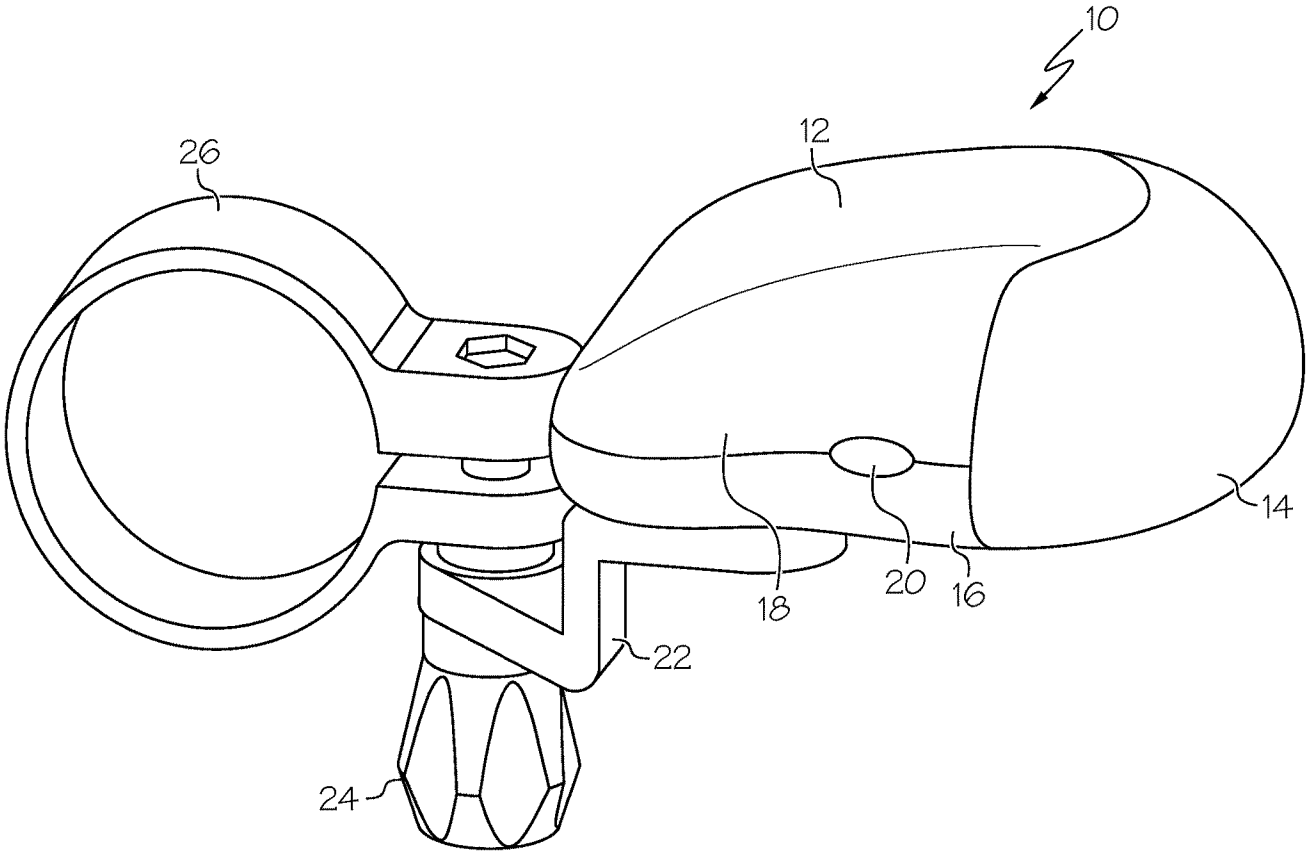
FIG. 1 illustrates a side view of an embodiment of a portable, secondary, rail mounted navigational lighting system used for the Port/Starboard side of a vessel according to one or more embodiments shown and described herein.

Referring to FIG. 1, a portable, secondary navigational lighting system 10 includes a housing 12 that houses a light source and a Red or Green colored Marine Lens 14. In the illustrated embodiment, one or more of the lights may produce light having this preselected Red or Green color. The colors of the light source may be used to comply with marine navigation regulations. Any suitable lighting source may be used, such as light-emitting diodes (LED).

The housing 12 includes a base 16 and a cover 18 that is removably attached to the base 16. The cover 18 may be a unitary configuration or may comprise one or more components that are releasably attached to the base 16. The cover 18 may be formed of a transparent or translucent material, such as a plastic or glass, such that light from the light sources can be viewed from outside the portable navigational lighting system 10. In some embodiments, the cover may be formed of tinted glass and/or plastic (e.g., red and green) that may provide the navigational color scheme.

In the illustrated embodiment, an actuatable button 20 is provided that allows for turning the light sources on and off. In some embodiments, the portable navigational lighting system 10 may include a solar panel, GPS chip, use RFID characteristics or similar tracking device that can aid in the retrieval of specific location information if needed or if in an emergency or like situation where exact position of the vessel is needed.

Figure 5:
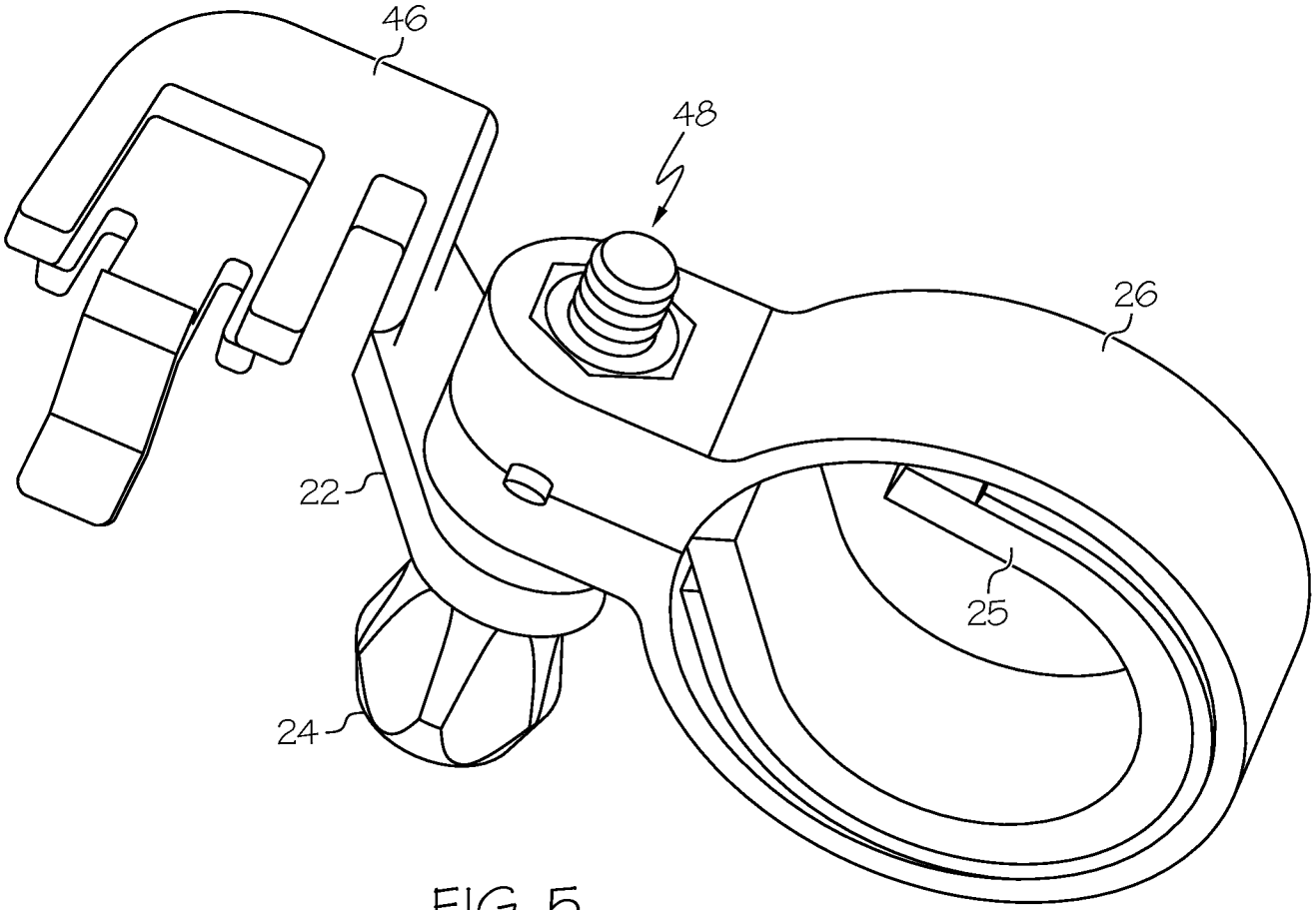
FIG. 5 illustrates a top plan view of the pivoting bracket system of the portable, secondary, rail mounted navigational lighting system of FIG. 1 without a light housing.

Referring also to FIG. 1, in the illustrated embodiment, a pivoting bracket 22 can be used to rotate the housing 12 to its proper angle to disperse light to the correct angles as by maritime law, specific to location. The pivoting bracket 22 may be provided for a wide range of adjustment so as to allow for pivoting to accommodate the placing of housing 12 to pivot correctly from the sides or front portions of the vessel's railing system or at points along the side railings, for example, at locations along a legal sideline location as may be set by law. A hand tightened pin and lock system 24 including a shaft (as shown in FIG. 1 and as shaft 48 in FIG. 5) allows for tightening of the housing 12 to releasably attach to and from multiple standard boat railing systems using the specially designed marine clamp mechanism 26 fitting railing sizes ½ inch to 3 inches in diameter. In some embodiments, as shown in FIG. 1, the pivoting bracket 22 is releasably connectable or attachable the housing 12 at a first end and pivotally disposed around the shaft 48 of the pin and lock system 24 at a second end. In some embodiments, the hand tightened pin and lock system 24 allows for tightening of the housing 12 to releasably attach to and from multiple boat railing systems using the specially designed marine clamp mechanism 26 fitting railing sizes less than about ½ inch and greater than about 3 inches in diameter, such as about 4, 5 and 6 inches or greater. In embodiments, and as shown in FIGS. 1 and 5, the clamp mechanism 26 has walls defining an aperture that is disposed around and attached to the shaft 48 of the pin and lock system 24.

Figure 2:
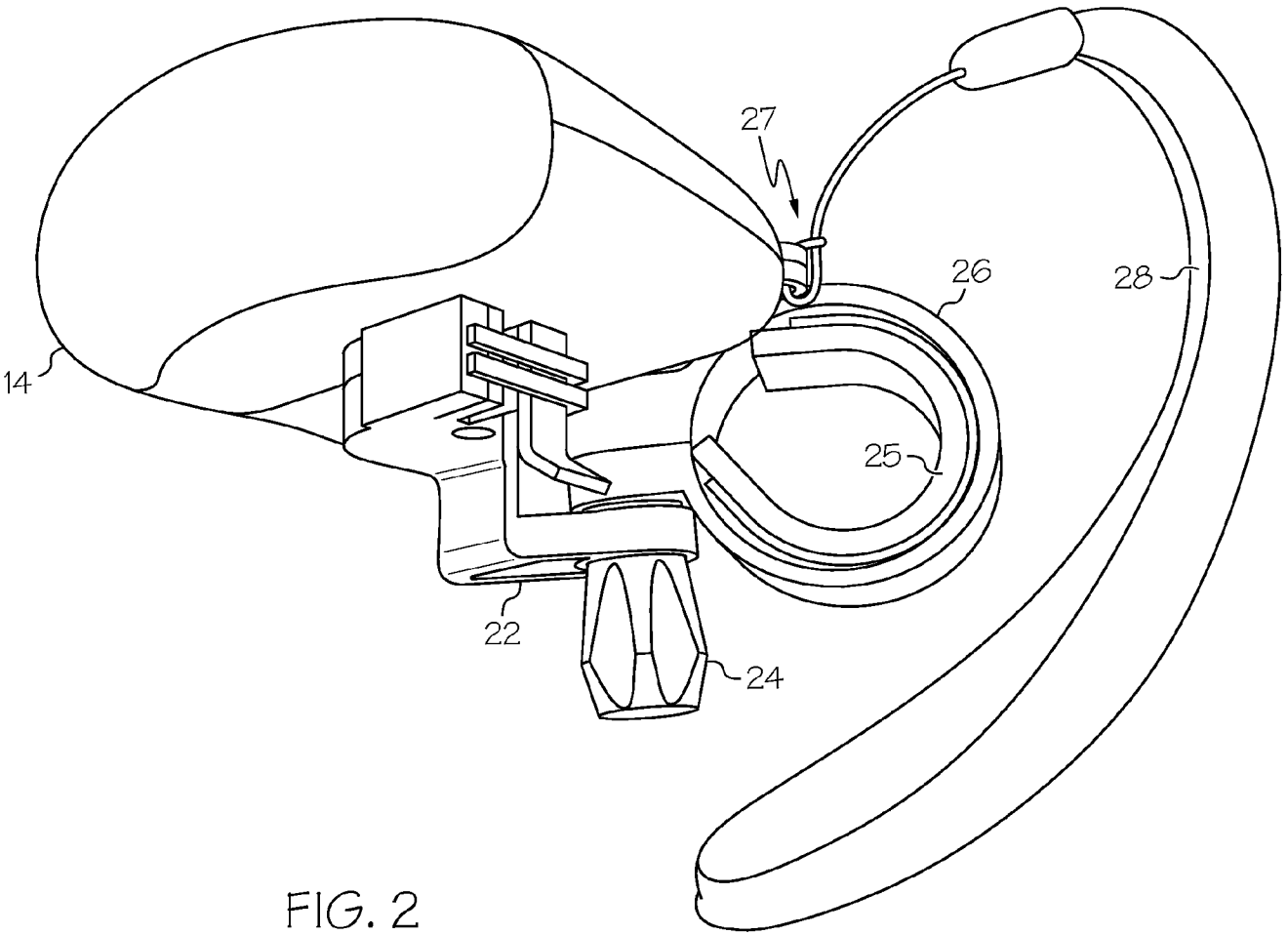
FIG. 2 illustrates a bottom view of the portable, secondary, rail mounted navigational lighting system of FIG. 1.

Referring to FIG. 2, a safety line insertion loop 27 is built into housing 12 and available to allow for a safety strap 28 to be connected to the housing 12 so as to provide safe retrieval of the housing 12 if it is to fall from pivoting bracket 22. This safety strap 28 may be made of multiple materials including, nylon, plastic, rubber, cloth or any other material suited for its purpose and may include a clip system on one or both ends to secure the strap to the housing 12 and/or to a vessel's railing system. Also shown is a clamp mechanism 26 sized for insertion within the marine clamp mechanism 26 to allow for additional sizing assistance and a better grip on boat railing systems.

Figure 3:
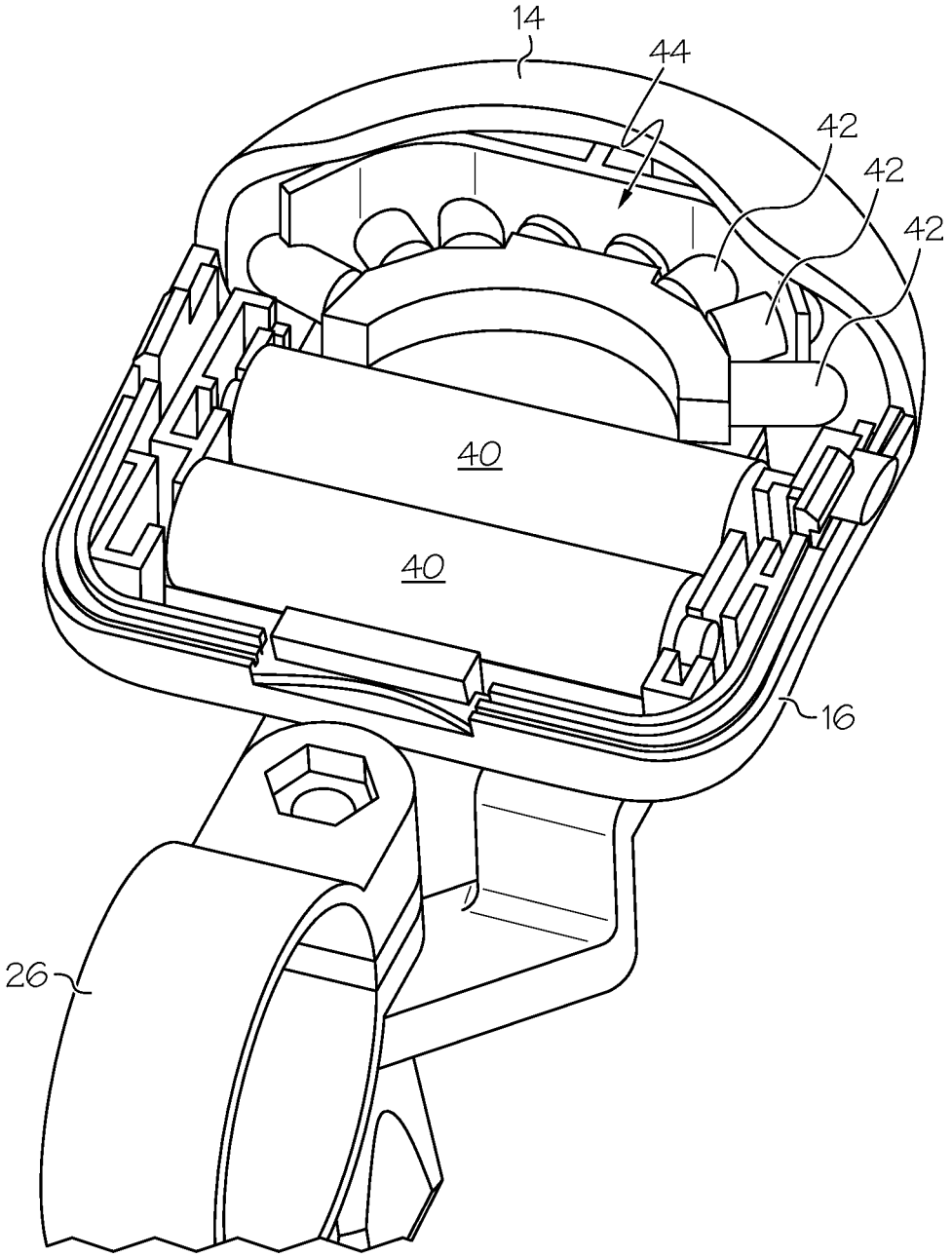
FIG. 3 illustrates a top plan view of the portable, secondary, rail mounted navigational lighting system of FIG. 1 without a top cover.

Referring to FIG. 3, the pivoting bracket 22 and the hand tightened pin and lock system 24 are illustrated from another top angle with the cover 18 removed to show more clearly the internal configuration of the housing 12 that includes its marine light source within such as a plurality of light-emitting diodes (LEDs) 42 extending through apertures of a front structure 44. Also shown in a pair of batteries 40 to power and illuminate the LEDs 42 of the portable, secondary navigational lighting system 10. The batteries 40 may be, for example, a pair of AAA batteries, though other suitable or like power supplies may be used. The housing 12 may accommodate a built in solar panel and/or the housing 12 may have rechargeable solar power capabilities.

Figure 4:
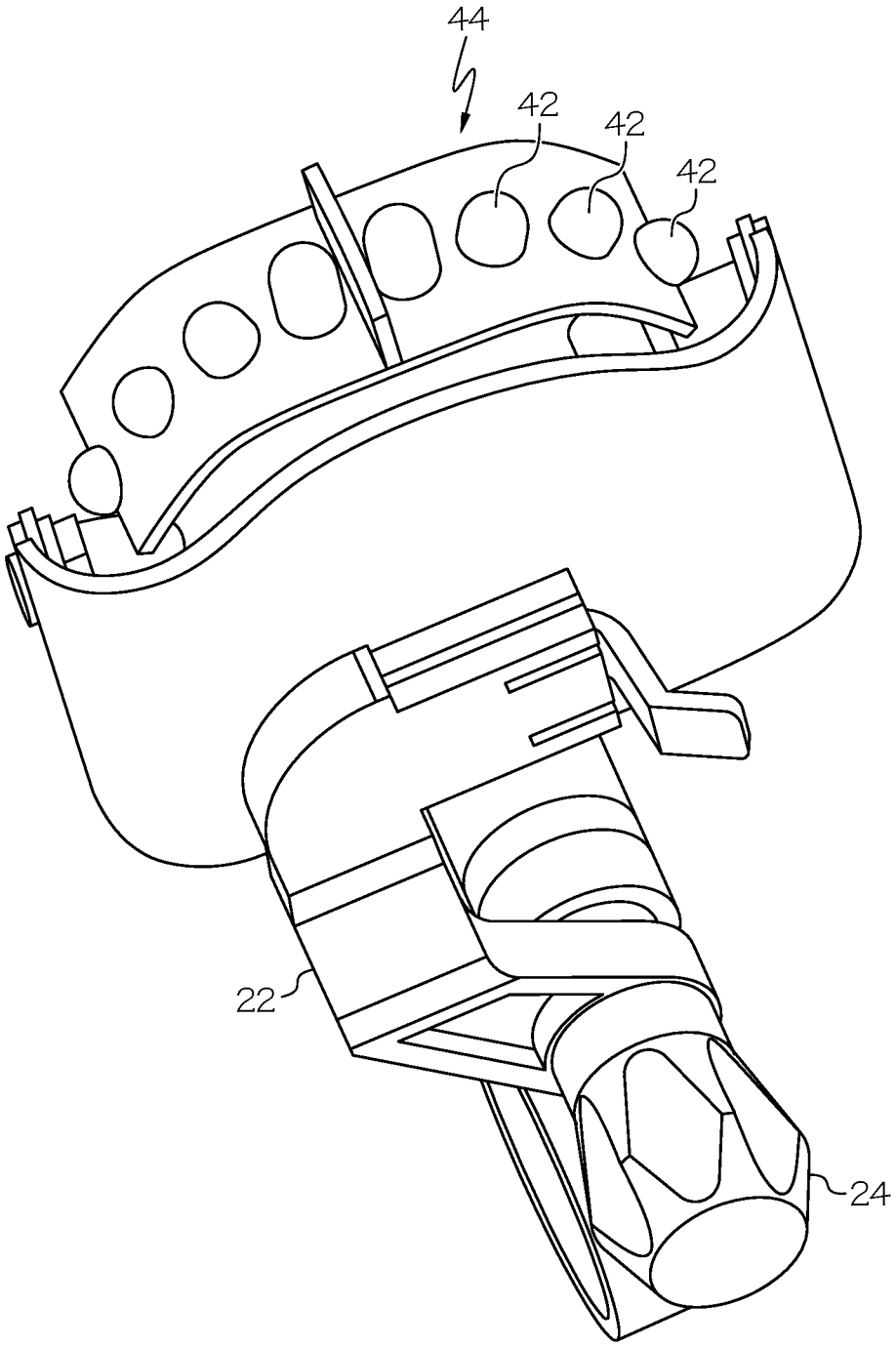
FIG. 4 illustrates another bottom view of the portable, secondary, rail mounted navigational lighting system of FIG. 1; without a cover or lens and focusing in on the pivoting bracket system and its key features.

FIG. 4 shows the pivoting bracket 22 and the hand tightened pin and lock system 24 with the lens 14 and the cover 18 removed. The pivoting bracket 22 and the hand tightened pin and lock system 24 is shown from yet another angle to show more clearly the specific configuration used to allow for pivoting of the housing 12 and its marine light source within. Front portions of the LEDs 42 are shown that have extended and projected through apertures of the front structure 44.

FIG. 5 shows a top plan view of the pivoting bracket 22 and the hand tightened pin and lock system 24 of the portable, secondary, rail mounted navigational lighting without the housing 12. The clamp mechanism 26 inserted within the marine clamp mechanism 26 is also shown. FIG. 5 also shows a grip structure 46 shaped to releasably attach to an underside of the housing 12 (not shown). And a screw and bolt assembly of shaft 48 to assist with the releasable locking of the hand tightened pin and lock system 24 is shown. In embodiments, any suitable or like assembly or mechanism to assist with the releasable locking of the hand tightened pin and lock system 24 may be used.

Figure 6A:
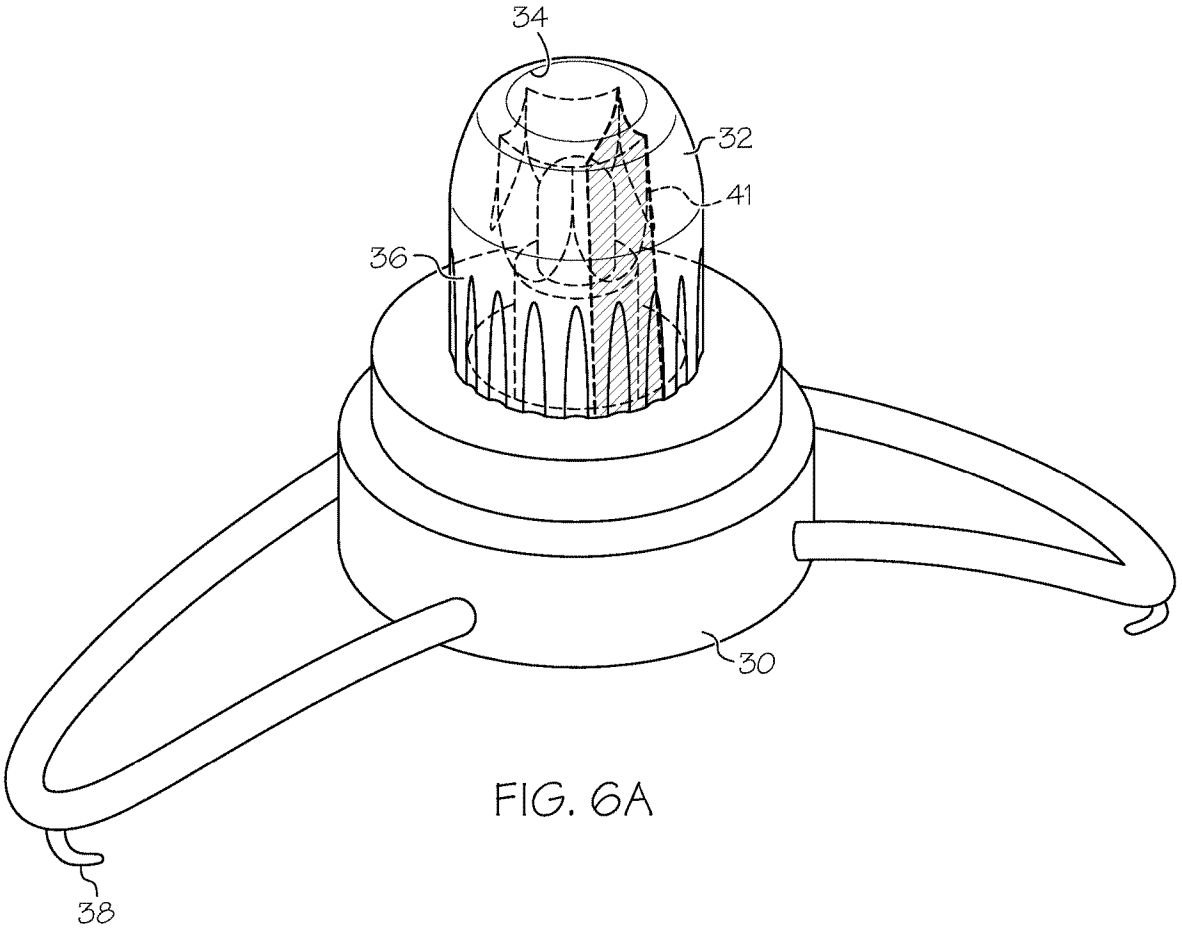
FIG. 6A illustrates an embodiment of a portable, secondary, rail mounted navigational lighting system used for the All Around Light or 360 Degree Light according to one or more embodiments shown and described herein.
Figure 6B:
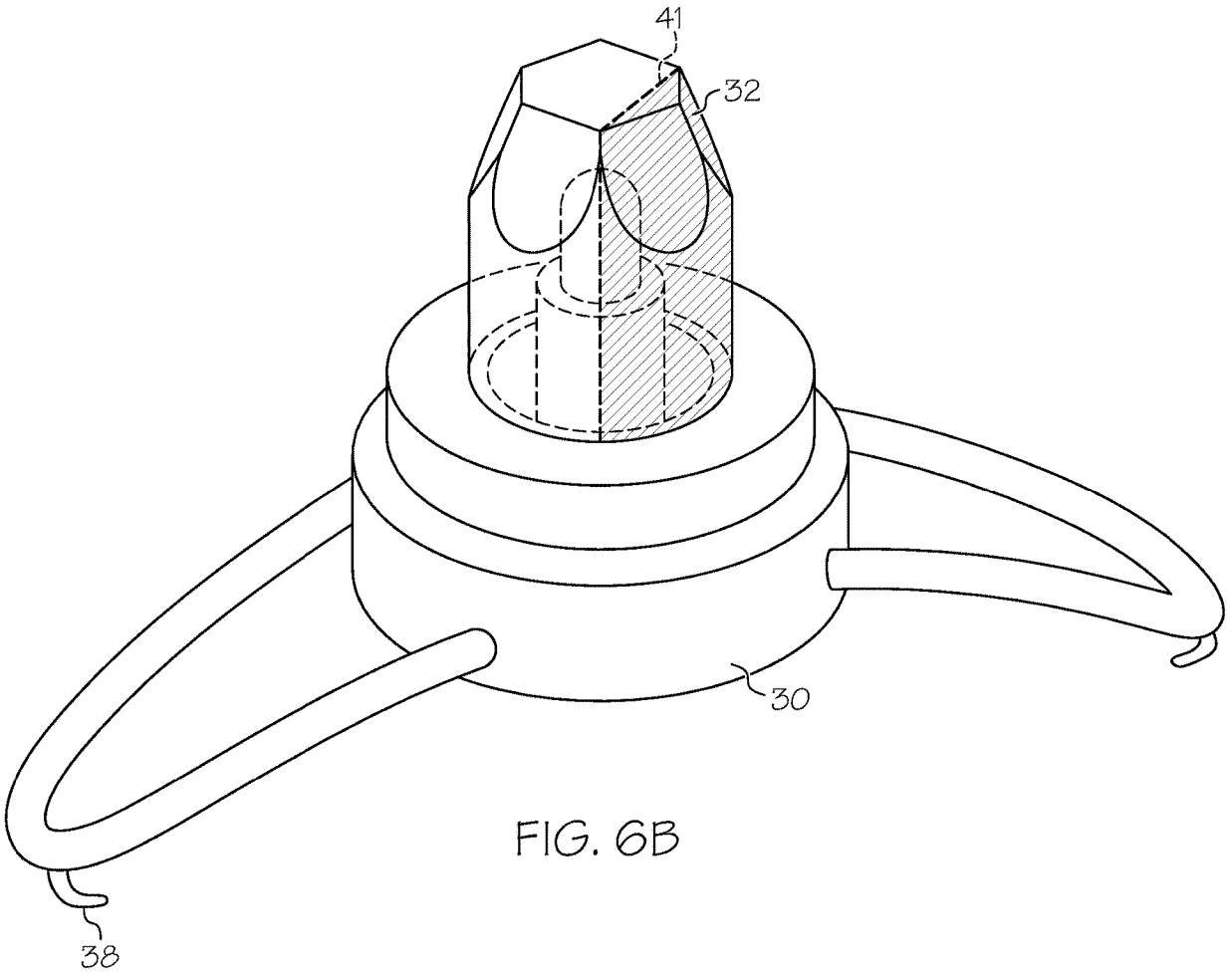
FIG. 6B illustrates an alternative embodiment of a portable, secondary, rail mounted navigational lighting system used for the All Around Light or 360 Degree Light according to one or more embodiments shown and described herein.

FIG. 6A illustrates another embodiment that consists of a separate All Around Housing 30 which has its own light source and a specially designed All Around Lens 32 which disperses light from the light source in 360 degrees so to be seen from every direction, including from above. FIG. 6B illustrates an alternative embodiment that consists of a separate All Around Housing 30 which has its own light source and a specially designed All Around Lens 32 which disperses light from the light source in 360 degrees so to be seen from every direction, including from above. Referring one again to FIG. 6A, the All Around Lens 32 consists of multiple magnification points 34 which redirect light from the light source to all directions. These magnification points may vary in size. The All Around Lens 32 can be turned on and off by depressing down the actual lens itself. There are multiple Magnification Streaks 36 built into the All Around Lens 32 to help further disperse light into all directions.

Still referring to FIG. 6A, the All Around Housing 30 is equipped with an All Around Housing Clip System 38 which is used to secure the All Around Housing to the multiple types of railing systems used by marine, nautical, or other like vessels or vehicles. This All Around Housing 30 can be made of multiple materials including plastic, silicone or rubber, which can be stretched to adjust for and attach to the multiple sizes, styles and shapes of the many railing systems used by marine vessels. The terms All Around and All Round may be used interchangeably within this disclosure.

Figure 7:
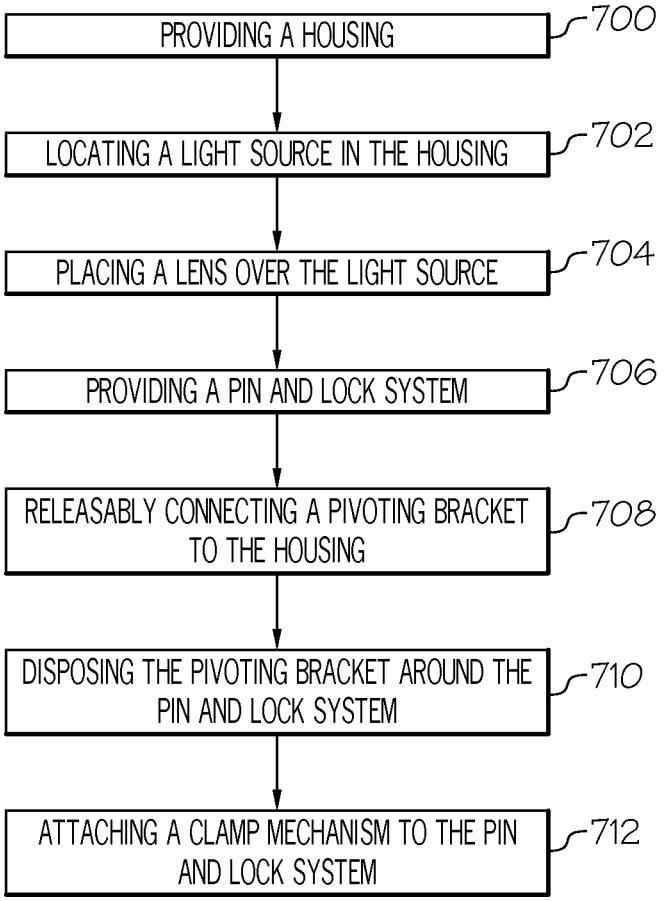
FIG. 7 illustrates a flow chart showing a method of making an embodiment of a portable, secondary, rail mounted navigational lighting system used for the Port/Starboard side of a vessel.

Referring to FIG. 7, a flow chart shows a method of using an embodiment of a portable, secondary, rail mounted navigational lighting system used for the Port/Starboard side of a vessel, such as using the portable, secondary navigational lighting system 10 embodiment of FIGS. 1-5 as described above. Referring to FIG. 7, and as described with respect to FIGS. 1-5 above, in step 700, the housing 12 is provided. In step 702, the light source such as LEDs 42 is located in the housing 12. The light source 42 is visible through the housing 12 when illuminated. In step 704, the lens 14 is placed over the light source 42 that externally illuminates at least an angle segment of the light from the light source 42 and controls the direction of illumination. In step 706, the pin and lock system 24 is provided and includes the shaft 48. In step 708, the pivoting bracket 22 is releasably connected to the housing at the first end of the pivoting bracket 22. In step 710, the pivoting bracket 22 is disposed around the shaft 48 of the pin and lock system 24 at a second end of the pivoting bracket 22. The second end is opposite the first end. In step 712, the clamp mechanism 26 is attached to the shaft 48 of the pin and lock system 24. The clamp mechanism 26 has walls defining an aperture, and the aperture is disposed around the shaft 48 of the pin and lock system 24. In embodiments, the clamp mechanism is releasably attached to the rail or rail structure of a boat. The pivoting bracket 22 is pivoted to a selected angle with respect to the rail or rail structure of the boat. At this angle, the pivoting bracket 22 faces away from the boat. The pivoting bracket 22 is locked into place with the pin and lock system 24 at the selected angle. For example, the pin and lock system 24 includes a threaded screw and bolt assembly as shown in FIG. 5 that may tighten against the pivoting bracket 22 to secure it in place at the selected angle and to restrict further pivoting of the pivoting bracket 22. Other suitable and/or like releasable locking assemblies are within the scope of this disclosure.

In embodiments, and as described above, when the light source such as LEDs 42 disperses a red light, the clamp mechanism 26 is releasably connected as a side light to a port side rail structure of the boat, a front rail structure of the boat, or at any point between a back-most port side rail structure point as may be set by law, for example, and the front rail structure. In embodiments, when the light source such as LEDs 42 disperses a green light, the clamp mechanism 26 is releasably connected as a side light to a starboard side rail structure of the boat, the front rail structure of the boat, or at any point between a back-most starboard side rail structure point as may be set by law, for example, and the front rail structure. In embodiments, with either a green or a red light being dispersed as a sidelight, LEDs 42 in combination with lens 14 may disperse or shine a 112.5 degrees angle segment of light.

Figure 8:
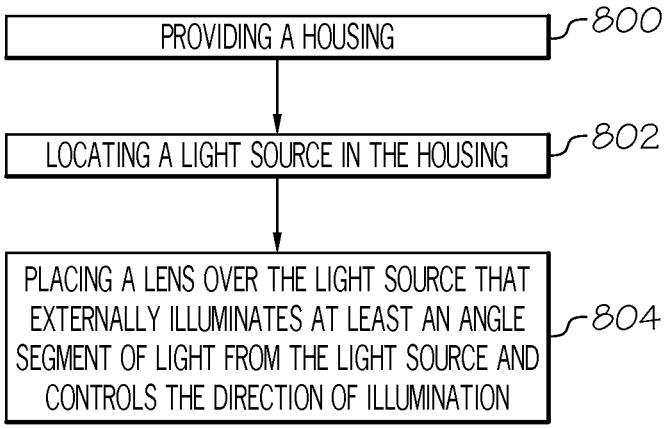
FIG. 8 illustrates a flow chart showing a method of making an embodiment of a portable, secondary, rail mounted navigational lighting system used for all-round lighting; stern lighting, and/or masthead lighting of a vessel.

Referring to FIG. 8, a flow chart shows a method of using an embodiment of a portable, secondary, rail mounted navigational lighting system used for all-round lighting; stern lighting, and/or masthead lighting of a vessel, such as using the All Around Housing 30 embodiment as described above and shown in FIGS. 6A-B. In step 800, the housing 30 is provided. In step 802, the light source as shown in FIGS. 6A-B is located in the housing 30. In step 804, the lens 32 is placed over the light source. The lens 32 externally illuminates at least an angle segment of light from the light source and controls the direction of illumination. In embodiments, the housing 30 is releasably connected to a rail of a boat. For example, and as described above with respect to FIGS. 6A-B, clip system 38 may secure housing 30 to the rail or like structure of the boat, such as to a top rail structure of the boat.

In embodiments, the lens 32 and the light source are together a lens and light source assembly. When the lens and light source assembly are mounted in a vertical direction, the lens 32 illuminates an angle segment of 360 degrees of light from the light source on a horizontal plane for use as an all around or all-round light. When the lens and light source assembly are mounted in a horizontal direction and usable as a sternlight, for example, the lens 32 illuminates an angle segment in a range of from about 130 degrees to about 140 degrees of light, such as, for example, 135 degrees of light, from the light source.

In embodiments, a fitted lens insert 41 is placeable within the lens 32 and over the light source of FIG. 6, for example, to create a fitted light source assembly and to restrict external illumination of up to a blocked first angle of light. The blocked first angle of light may be, for example, 135 degrees such that the lens 32 illuminates an angle segment of 225 degrees of light. For example, 225 degrees of light is externally illuminated and viewable rather than a full 360 degrees of light as 135 degrees of the light from the light source is now blocked by the fitted lens insert 41. In embodiments, such a fitted light source assembly is usable as a masthead light.

Figure 9A:
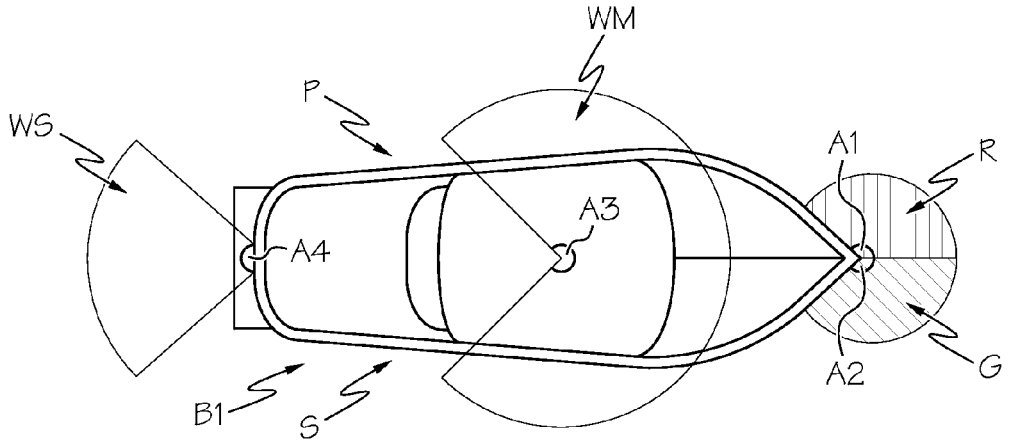
FIG. 9A illustrates a top plan view of a vessel having a first setup of lighting according to one or more embodiments shown and described herein.
Figure 9B:
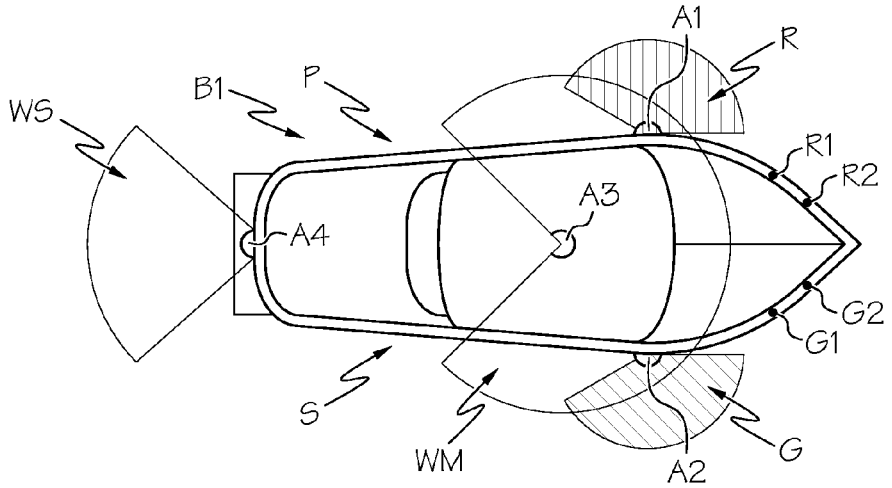
FIG. 9B illustrates a top plan view of a vessel having an alternative second setup of lighting according to one or more embodiments shown and described herein.
Figure 10:
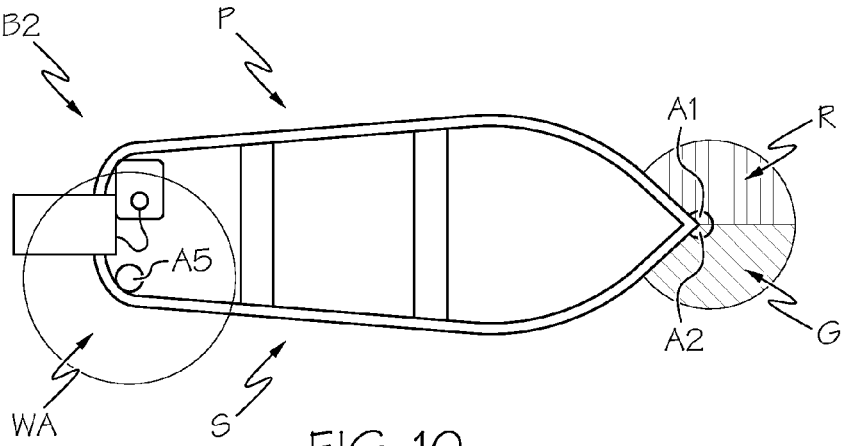
FIG. 10 illustrates a top plan view of another vessel having an alternative third setup of lighting according to one or more embodiments shown and described herein.

Referring to FIGS. 9A-10 illustrates vessels B1 and B2, in embodiments, the light sources described herein may be used as a sidelight, a sternlight, a masthead light, and/or an all-round light to disperse the light to its proper direction as required by law. As a red sidelight R or green sidelight G on a respective port side P or starboard side S, the light may be dispersed at a respective angle A1 or A2 in a range of from about 110 degrees to about 120 degrees, for example, at about a 112.5 degrees angle. As shown in FIGS. 9A and 10, the red sidelight R and green sidelight G may be adjacently positioned at the front bow of the boat. Alternatively, as shown in FIG. 9B, the red sidelight R and the green sidelight G may be spaced part from one another and positioned on respective opposite port and starboard sides P and S of a vessel such as the vessel B1. In embodiments, the red sidelight R and the green sidelight G may be positioned anywhere on respective port rails or starboard rails, such as, for example, between the positions shown in FIGS. 9A and 9B, such as at exemplary positions R1 and G1 or R2 and G2. As a sternlight WS (FIGS. 9A and 9B), the light may be a white light dispersed at an angle A4 in a range of from about 130 degrees to 140 degrees, for example, at a 135 degrees angle. As a masthead light WM (FIGS. 9A and 9B), the light may be a white light dispersed at an angle A3 in a range of from about 220 to about 230 degrees, for example, at about a 225 degrees angle. Referring to FIG. 10, as an all-round light WA, the light may be a white light dispersed at an angle A5 that is about a 360 degrees angle. In embodiments, for power-driven vessels of less than 39.4 feet in length, for example, the all-round light WA of FIG. 10 may combine the sternlight light WS and the masthead light WM shown in FIGS. 9A-9B. In embodiments, the all-around light WA may be located top and center of a vessel.

The above-described portable and externally wireless navigational lighting systems can be used to meet navigational lighting requirements at various locations around the world. The portable and externally wireless navigational lighting systems can be quickly and easily removably attached to multiple positions along a vessel's railing system and pivoted to disperse navigational light at the proper angles. In some embodiments, the portable and externally wireless navigational lighting systems may be used in secondary or back up situations and may be used to provide emergency flashing and S.O.S. capabilities. For example, two or more flashing settings may be provided along with an S.O.S. setting or other Morse code setting. In some embodiments, a customizable Morse code or other code setting may be provided. In these embodiments, a controller and memory may be provided for creating and saving customized settings. In some embodiments, customizable settings may be generated using a computing device, such as a smart phone, tablet or laptop with suitable mobile application software.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A portable and externally wireless navigational lighting system comprising:

a housing;

a light source located in the housing and visible through the housing when illuminated;

a pin and lock system including a shaft and a grip portion disposed below and extending longitudinally from the shaft;

a pivoting bracket releasably connectable to an underside of the housing at a first end comprising a first level and pivotally disposed around a first portion of the shaft of the pin and lock system at a second end comprising a second level disposed below the first level; and a clamp mechanism having walls defining an aperture disposed around and attached to a second portion of the shaft that is disposed above the first portion of the shaft of the pin and lock system and above the grip portion such that the aperture of the clamp mechanism is not disposed around the first portion of the shaft and the grip portion, wherein the clamp mechanism is releasably attachable to a rail of a boat, wherein the grip portion is configured to rotate to release or secure the clamp mechanism to the rail of the boat.

2. The system of claim 1, wherein the light source includes one or more LEDs.

3. The system of claim 1, wherein the light source illuminates a green light.

4. The system of claim 3, wherein the clamp mechanism is releasably connected to a starboard side railing of the boat and wherein the green light shines away from the boat.

5. The system of claim 1, wherein the light source illuminates a red light.

6. The system of claim 5, wherein the clamp mechanism is releasably connected to a port side railing of the boat and wherein the red light shines away from the boat.

7. The system of claim 1, wherein the light source illuminates a white light.

8. The system of claim 1, wherein the light source provides a light that shines at angle in a range of from 110 degrees to 120 degrees.

9. A method of making a portable and externally wireless navigational lighting system comprising:

providing a housing;

locating a light source in the housing, wherein the light source is visible through the housing when illuminated;

placing a lens over the light source, wherein the lens externally illuminates at least an angle segment of light from the light source and controls a direction of illumination;

providing a pin and lock system including a shaft and a grip portion disposed below and extending longitudinally from the shaft;

releasably connecting a pivoting bracket to an underside of the housing at a first end comprising a first level;

disposing the pivoting bracket around a first portion of the shaft of the pin and lock system at a second end comprising a second level disposed below the first level;

attaching a clamp mechanism to the shaft of the pin and lock system, wherein the clamp mechanism has walls defining an aperture, wherein the aperture is disposed around a second portion of the shaft that is disposed above the first portion of the shaft of the pin and lock system and above the grip portion such that the aperture of the clamp mechanism is not disposed around the first portion of the shaft and the grip portion, and rotating the grip portion to release or secure the clamp mechanism to a rail of the boat.

10. The method of claim 9, further comprising using the portable and externally wireless navigational lighting system, wherein the using comprises:

releasably attaching the clamp mechanism to a rail of a boat;

pivoting the pivoting bracket to a selected angle with respect to the rail and facing away from the boat, wherein the angle segment is in a range of from 110 degrees to 120 degrees of light; and locking, via the pin and lock system, the pivoting bracket in position at the selected angle.

11. The method of claim 10, wherein the light is one of red or green, wherein, when the light is red, releasably connecting the clamp mechanism to a rail of the boat comprises releasably connecting the clamp mechanism to a port side rail structure of the boat, and wherein when the light is green, releasably connecting the clamp mechanism to a rail of the boat comprises releasably connecting the clamp mechanism to a starboard side rail structure of the boat.

12. A method of making a portable and externally wireless navigational lighting system comprising:

providing a housing;

locating a light source in the housing;

placing a lens over and surrounding the light source, wherein the lens externally illuminates at least an angle segment of light from the light source and controls a direction of illumination, wherein the lens is configured to be depressed to turn the light source between on and off, and wherein at least one of the lens and the light source comprises:

a side portion and a top portion, wherein:

the side portion comprises a concentric cross-section and a planar sidewall extending between a bottom outer-most periphery of the side portion and a top outer-most periphery of the side portion and configured to illuminate an all-around direction of illumination, and the top portion comprises vertically-extending angled segments directly extending upwardly and inwardly from the top outer-most periphery of the side portion and comprising a slope defined by a height between the top outer-most periphery of the side portion and a top surface of the top portion and configured to illuminate a restricted angle segment direction of illumination; and using the portable and externally wireless navigational lighting system, wherein the using comprises:

releasably connecting the housing to a rail of a boat, wherein the lens and the light source comprise a lens and light source assembly, wherein the lens externally illuminates the angle segment of 360 degrees of light from the light source on a horizontal plane when the lens and light source assembly is mounted in a vertical direction, and wherein the lens externally illuminates the angle segment in a range of from 130 degrees to 140 degrees of light from the light source on the horizontal plane when the lens and light source assembly is mounted in a horizontal direction.

13. The method of claim 12, wherein the top portion comprises a hexagon, and, when mounted in the horizontal direction, the lens and light assembly is usable as a sternlight through utilizing the angled segments of the top portion to illuminate the restricted angle segment direction of illumination.

14. The method of claim 12, wherein when mounted in the vertical direction, the lens and light assembly is usable as an all-round light through utilizing the planar sidewall of the side portion to illuminate the all-around direction of illumination.

15. The method of claim 14, wherein the all-round light comprises both a sternlight and masthead light on the boat, wherein the boat is a power-driven vessel of less than 39.4 feet in length.

16. The method of claim 12, further comprising a fitted lens insert placed within and fully surrounded by the lens, such that the lens is disposed completely outer to the fitted lens insert disposed within the lens, and placed over the light source such that the fitted lens insert is placed between the lens and the light source to create a fitted light source assembly and to restrict external illumination of up to a blocked first angle of light.

17. The method of claim 16, wherein the blocked first angle of light is 135 degrees such that the lens illuminates the angle segment of 225 degrees of light.

18. The method of claim 17, wherein the fitted light source assembly is usable as a masthead light.

19. The method of claim 12, wherein the lens comprises at least one of multiple magnification points or multiple magnification streaks built into the lens to externally illuminate at least the angle segment of light from the light source and control the direction of illumination.

* * * * *